US005221088A

United States Patent [19]

McTeigue et al.

[11] Patent Number: 5,221,088

[45] Date of Patent: Jun. 22, 1993

[54] SPORTS TRAINING SYSTEM AND METHOD

[76] Inventors: Michael H. McTeigue, 333 Fay Way, Mountain View, Calif. 94043; Art Zias, 941 Oxford Dr., Los Altos, Calif. 94022

[21] Appl. No.: 644,084

[22] Filed: Jan. 22, 1991

[51] Int. Cl.[5] ..... A63B 69/36

[52] U.S. Cl. ..... 273/187.2; 434/252; 434/253; 73/379.02; 273/187 R; 273/81 R; 273/187.5

[58] Field of Search ..... 273/187 R, 187 B, 188 R, 273/188 A, 189 R, 189 A, 190 R, 190 C, 183 B, 183 D, 186 R, 186 E, 440, 193 R, 81 R, 81.2, 81.4; 340/323 R; 128/25 B; 177/210 C, 199, 200; 482/52, 7, 74; 73/379-381; 434/252, 253, 392

[56] References Cited

U.S. PATENT DOCUMENTS

| | | | |
|---|---|---|---|
| 1,530,519 | 3/1925 | Remington | 273/188 R |
| 2,626,151 | 1/1953 | Jenks | 273/190 R |
| 3,169,022 | 2/1965 | Kretsinger | 273/183 B |
| 3,352,559 | 11/1967 | Larsen | 273/195 R |
| 3,397,892 | 8/1968 | Stahl | 273/190 R |
| 3,413,006 | 11/1968 | Beston | 273/187 R |
| 3,670,574 | 6/1972 | Edwards | 273/183 B |
| 3,792,863 | 2/1974 | Evans | 273/186 A |
| 3,897,058 | 7/1975 | Koch | 73/379 |
| 3,994,501 | 11/1976 | O'Donnell | 273/183 A |
| 4,304,406 | 12/1981 | Cromarty | 273/187 R |
| 4,318,546 | 3/1982 | Chen | 273/188 R |
| 4,326,718 | 4/1982 | Kiehl | 273/187 R |
| 4,337,049 | 6/1982 | Connelly | 434/247 |
| 4,502,035 | 2/1985 | Obenauf et al. | 340/323 B |
| 4,516,110 | 5/1985 | Overmyer | 434/253 |
| 4,527,982 | 7/1985 | Salzman et al. | 434/258 |
| 4,560,166 | 12/1985 | Emerson | 273/183 B |
| 4,577,868 | 3/1986 | Kiyonaga | 273/183 A |
| 4,662,640 | 5/1987 | Grander | 273/183 B |
| 4,861,034 | 8/1989 | Lee | 273/81.2 |
| 4,869,509 | 9/1989 | Lee | 273/183 B |
| 4,930,785 | 6/1990 | Mills | 273/194 R |
| 5,049,079 | 9/1991 | Furtado et al. | 434/253 |

OTHER PUBLICATIONS

"Biofeedback and Sports Science"; Edited by Jack H. Sandweiss and Steven L. Wolf; Plenum Press; Publication Date unknown; pp. 20-23 & 174-177.

Advertisement: Golf Shop Operations; Reader Service No. 102, p. 80: J-PAR Golf Company advertisement (Ad #J-PAR 1244).

*Primary Examiner*—William H. Grieb

*Assistant Examiner*—Steven B. Wong

[57] ABSTRACT

A sports training aid has a pair of foot sensors, insertable in a pair of shoes, which generate measurement signals indicative of weight applied to each of the foot sensors. The training aid compares the measurement signals with a specified range of values and produces audible sounds indicative of the relationship between those measurement signals and the specified range of values, thereby providing the training aid's user with immediate audible feedback regarding weight shifts. A grip sensing version of the sports training aid uses a grip pressure sensor which generates a measurement signal indicative of grip pressure applied to the handle of a swingable object, such as a golf club or baseball bat. When the user's grip pressure falls outside specified threshold values, audible tones are generated. In both versions, the user receives the audible feedback signals via a headset worn while using the sports training aid. A spinal tilt version is used to train a person to maintain proper spinal tilt during a sports motion, and a shoulder rotation is used to train a person to achieve a proper degree of shoulder rotation during a sports motion such as the golf backswing. In each version, the sensor(s) include a transmitter which transmits the measurement signals at a predefined frequency. The transmitted measurement signals are received by a comparator which compares the received signals with the specified range of values. As a result, the sensors and comparator need not be physically connected.

55 Claims, 8 Drawing Sheets

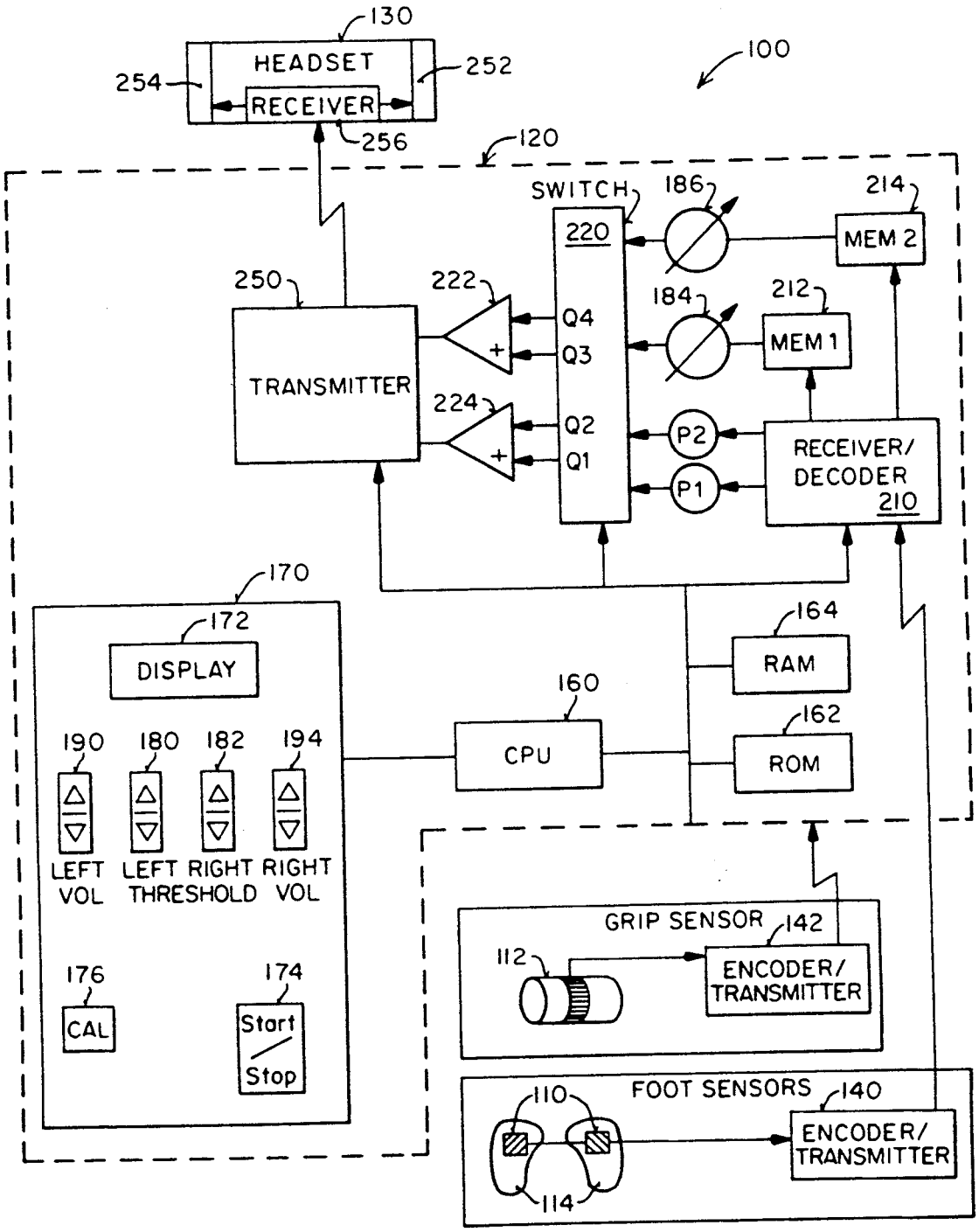
FIG 2
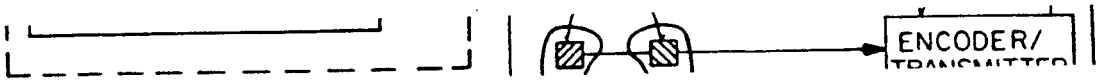

SPORTS TRAINING SYSTEM AND METHOD

The present invention relates generally to automated sports training equipment and particularly to a golf teaching aid using real time feedback techniques to help golf players learn fundamentals of swinging a golf club.

BACKGROUND OF THE INVENTION

Many different types of systems and techniques have been employed to help individuals improve their skills in playing various athletic sports, including such sports as baseball, tennis and golf. The goal of such systems and techniques is often to teach the individual how to control the position and motion of various portions of the person's body during a particular movement, such as during the swing of a tennis racket or golf club.

For instance, a number of different systems have been used to analyze the position and motion of a person's body while he or she swings a golf club. Such systems include motion picture cameras, stationary weighing platforms, lights attached to the subject and the like. These systems use various instruments and recording apparatus to measure and record such parameters as arm position and distribution of weight. After the subject has completed a particular motion, the data are gathered and reviewed. Often these data are compared to data taken using a highly skilled subject, such as an expert player. By comparing these data, a student learns, after the fact, what portion of his position or motion should be altered in order to more closely mimic that of the expert.

The above described prior art systems and methods, while providing analytic measurements, are generally only marginally effective in providing training, at least for most individuals. A major downfall of many such systems is that they can be used only in a laboratory setting, and cannot be used during normal play. Laboratory settings, with artificial playing surfaces, cameras, etc., create an environment conducive to good clinical observation, but one that is far removed from that in which the player must ultimately perform. Transference to the actual play environment diminishes the efficacy of such training.

A second major problem with the above described prior art system and methods is that the information obtained is provided to the subject after the conclusion of the particular action being analyzed. The longer the time delay between the motion and the analysis, the less effective the training method will be. Real time feedback is much more effective than such delayed analyses.

Another class or type of training systems and methods employs various physically constraining devices, which are worn by, or attached to the subject. These devices are intended to restrain the position or motion of portions of the subject's body, such that his position or motion are restricted within predetermined limits. This type of training aid is generally of little value. Such intrusive devices create an unrealistic learning environment, often causing the subject to work against the constraint, relying upon the device itself to limit the subject's position or motion. Once the constraint is removed, the subject must then employ muscular action that is far different from the actions used while constrained in order to limit his/her position or motion. Furthermore, such devices are clumsy to use during regular play and often interfere with other legitimate actions required at other times during play.

It is well known that it is important for a golf player to properly distribute his/her weight on his/her two feet, and to steadily maintain proper grip pressure on the golf club. Similar skills are required for other sports, such as tennis and baseball. These skills are difficult to learn without extensive assistance from a professional teacher, typically involving great expense. The present invention provides low cost apparatus which gives golf players real time feedback regarding weight distribution, grip pressure and the position and motion of various parts of the player's body while actually playing the game, thereby giving them continuous training that would be otherwise hard to achieve.

SUMMARY OF THE INVENTION

It is an object of the present invention to provide a sports training aid that is portable, useable in the actual sport environment with the player's own equipment, which does not restrict or encumber the player in any way, and which provides real time feedback.

Other objects of the present invention are to provide a programmable sports training aid which allows the user to learn at the margin of the user's current skill level, which is adaptable to specific teaching preferences, and which can be programmed to perform a number of different training routines for different sports motions.

In summary, the present invention is a sports training aid. In a first embodiment, the training aid has a pair of foot pressure/weight sensors, insertable in a pair of shoes, which generate measurement signals indicative of weight applied to each of the foot sensors. The training aid compares the measurement signals with a specified range of weight values and produces sensory feedback, such as audible sounds, indicative of the relationship between those measurement signals and the specified range of weight values. This provides the training aid's user with immediate audible feedback regarding weight distribution prior to and during the sports motion.

A grip sensing version of the sports training aid uses a grip pressure sensor which generates a measurement signal indicative of grip pressure applied to the handle of a swingable object, such as a golf club or baseball bat. When the user's grip pressure falls outside specified threshold values, audible tones are generated.

A spine tilt sensing version of the sports training aid uses an inclinometer to sense the inclination of the user's spine, and to generate a measurement signal indicative of the spine's angular inclination with respect to true vertical. Audible tones are generated, indicative of the relationship between the measured value and a specified target value of spinal tilt, or a specified target range of spinal tilt values.

A shoulder rotation sensing version of the sports training aid uses an angular position sensor to measure the user's shoulder rotation about his spinal axis, and to generate a measurement signal indicative of the relationship between the measured shoulder rotation and a specified value of rotation, or a specified range of rotation values.

In each version, the user receives the audible feedback signals via a headset worn while using the sports training aid. Also, in each version the pressure sensor(s) include a transmitter which transmits the measurement signals at predefined frequencies. The transmitted measurement signals are received by a control unit which compares the received signals with a specified value or range of values. As a result, the sensors and comparator need not be physically connected.

BRIEF DESCRIPTION OF THE DRAWINGS

Additional objects and features of the invention will be more readily apparent from the following detailed description and appended claims when taken in conjunction with the drawings, in which:

FIG. 2 is a block diagram of the preferred embodiment of the present invention.

DESCRIPTION OF THE PREFERRED EMBODIMENTS

While the sports training aid of the present invention is useful for training a person to acquire skills in a number of different sports, the preferred embodiment is a golf training aid and therefore the invention will be described as implemented for training golf players.

Figure 1:
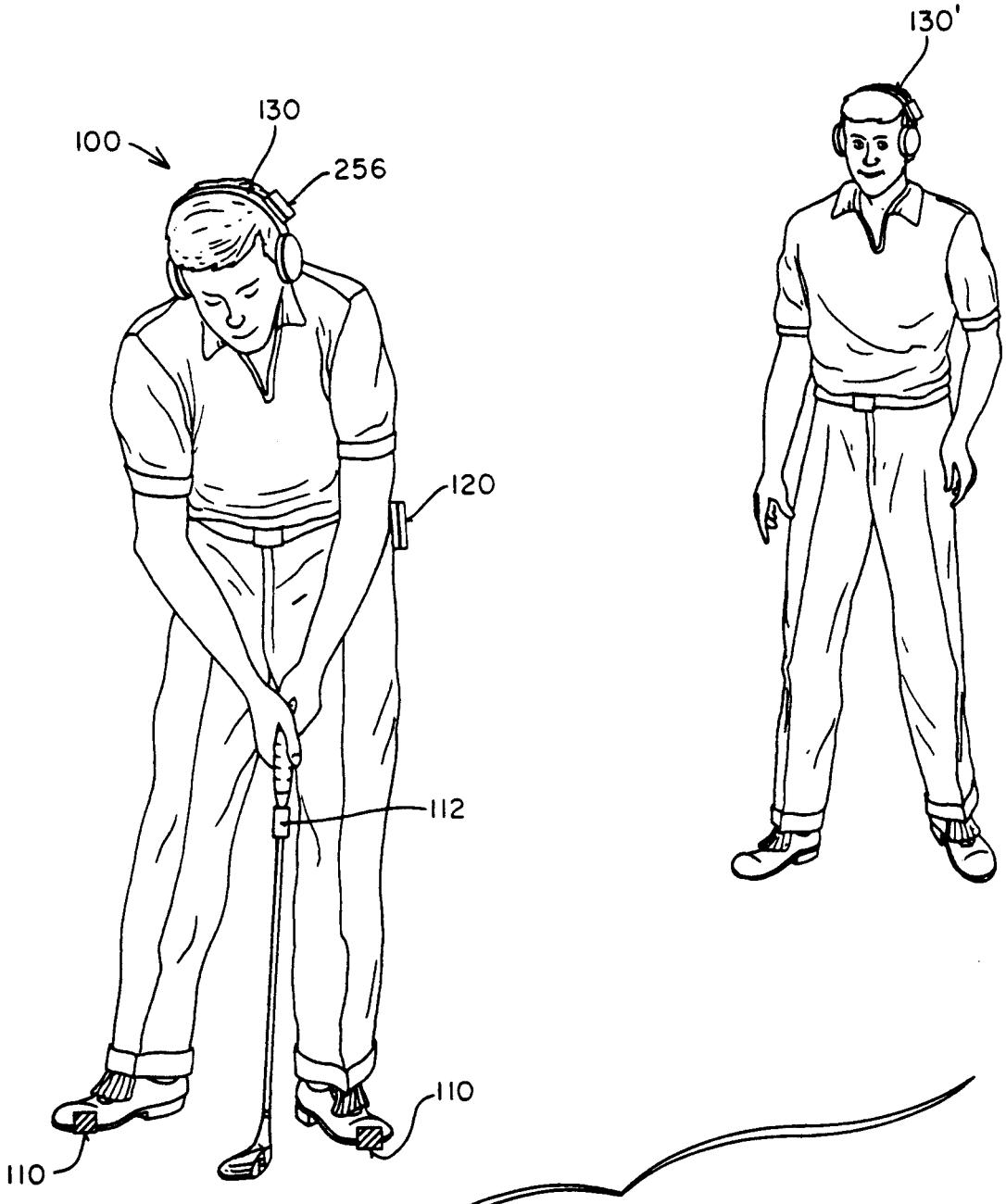
FIG. 1 depicts a person swinging a golf club.

Referring to FIG. 1, there is shown an illustration of a golf player preparing to strike a golf ball while wearing the present invention. The training aid 100 of the present invention has three primary components: pressure sensors 110–112, located either in the player's shoes or on the golf club's grip, a control unit 120, and a headset 130.

When used as a weight distribution training aid, the training aid 100 helps the user learn to distribute his weight properly throughout various portions of the golf swing. A golf player should maintain relatively equal amounts of weight on each foot when initially addressing the ball. A right-handed golf player's weight should then be shifted predominantly to the right foot during his backswing, with approximately eighty percent of his weight borne on his right foot. The golfer's weight should then shift smoothly to his left foot as he begins his downstroke, such that at least eighty percent of his weight is on his left foot when the club makes contact with the ball.

In the preferred embodiment, a foot sensor is located in each of the golfer's shoes, such that the weight on each foot is monitored, although monitoring of the weight on a single foot has proved to be useful. The training aid can be configured and programmed such that as the golfer starts his weight shift during his backswing, he receives a steady, reinforcing tone in his right ear provided that he shifts at least a pre-selected amount of his weight to his right foot. If the golfer places less than the pre-selected amount of weight on his right foot, he receives no reinforcing tone. Similarly, during his downstroke the golfer receives a steady reinforcing tone in his left ear, provided he has shifted at least a pre-selected amount of his weight to his left foot. Again, if he shifts insufficient weight to his left foot, he receives no reinforcing tone in his left ear.

In an alternate embodiment, the training aid may be configured (using software) so that it provides no tones to the golfer unless his weight shift falls outside a pre-selected range. In this case, a "fault" tone sounds to alert the golfer that his weight shift has fallen outside the pre-selected range. The fault tone is sounded in the ear corresponding to the offending foot. It is preferred in this embodiment that the fault tones be set at a low pitch for too little weight, and at a higher pitch for too much weight on the corresponding foot.

This real time feedback, either in the form of reinforcing tones or in the form of "fault" tones, helps the golf player to learn the proper weight distribution (between left and right feet) and shift throughout his golf swing.

It should be noted that in most applications, the use of fault tones is interchangeable with the use of reinforcing tones. That is, instead of informing the user when his/her motion is wrong, the device can be programmed to produce audio feedback when the user's motion is correct. The type of sensory feedback given is thus a discretionary matter, and the present invention is capable of generating either negative or positive types of sensory feedback signals.

When used as a grip pressure training aid, the training aid 100 helps the user learn to maintain relatively light, constant grip pressure while swinging a golf club. When the user's grip pressure falls outside a specified "window" of pressure values (e.g., between two specified percentages of the user's maximum grip pressure) a warning tone is instantaneously transmitted to the headset 130. Low grip pressure is signaled by a low frequency tone while excessive grip pressure is signaled by a higher frequency tone. Alternatively, a reinforcing tone could be generated whenever the user is applying proper grip pressure. The real time feedback provided by the present invention helps the player to maintain proper grip pressure, and to learn the feel of proper grip pressure throughout the golf swing. In an alternate embodiment, the grip pressure sensor 112 could be divided into two or three sensors for measuring grip pressure by various parts of the user's hands, with sensory feedback being generated by the sports training aid in response to each sensor's grip pressure measurements.

When used as a spine tilt training aid, the sports training aid 100 helps the user learn to control the tilt of his/her spine during his backswing and downswing. A golf player should incline his spine forward, toward the ball when initially addressing the ball. This angle should be between approximately 10 degrees and 30 degrees from true vertical, depending on the preference of the individual player. This angle should remain substantially constant throughout the player's backswing and downswing, at least until the player's golf club strikes the ball.

When used as a shoulder rotation training aid, the sports training aid 100 helps the user learn to control the amount of angular rotation of his shoulder line about his spinal axis. A golf player should rotate his shoulder line between 85 and 100 degrees during a proper backswing. Too little shoulder rotation will contribute to improper uncoiling of the body during the downswing, and to excessive use of the player's arms in an attempt to gain the desired striking power. Excessive shoulder rotation can result in improper rotation of the hips during the backswing, thereby disturbing the position of the player's torso as well as his/her balance.

The present invention can be used by a professional trainer to help his/her students learn to perform certain motions properly. When used in this way, the system will typically include both a headset 130 worn by the student and a second headset 130' worn by the trainer. The range of the transmitter in the control unit 120 is about fifteen feet, allowing a nearby observer wearing a second headset 130' to hear the same feedback tones as heard by the student.

Referring to FIG. 2, the preferred embodiment of the sports training aid 100 contains a number of distinct training programs. As of the date of filing of this document, the preferred embodiment of the training aid contains six such training programs: a first program for using the training aid 100 as a weight shift training aid, a second program for using the training aid as a grip pressure training aid, a third program for spinal tilt training, a fourth program for shoulder rotation training, a fifth program for combined grip pressure and left foot weight shift training, and a sixth program for combined spinal tile and left foot weight shift training. At any one time, depending on the training program selected by the user, a set of corresponding sensors will be activated. It is anticipated that additional training programs, using either the same sensors or additional sensors, will be added to the training aid.

FOOT AND GRIP SENSORS

In the preferred embodiment, each foot sensor comprises a thin pad 114 that fits into the user's shoe. The shape of the pad 114 conforms to the shape of the shoe and may be trimmed about its outer edges to fit the specific size and shape of any particular person's shoe. The sensing means or element 110 (herein called the foot weight sensor) in the foot sensor is located so that it senses the weight borne by at least a portion of the ball of the user's foot, although other embodiments may also sense the weight borne by at least a portion of the heel of the user's foot. Thus the foot sensor measures the amount of weight borne by a specific region or regions of the foot. The foot sensors pads 114 are comfortable, moisture resistant, and provide a non-slip surface.

Each foot weight sensor 110 is a variable impedance device whose impedance changes in relation to the amount of weight applied to the foot weight sensor 110. Each foot weight sensor 110 is coupled to an encoder/-transmitter 140, which reads the impedance of the sensors and transmits a corresponding radio frequency (RF) signal. The encoder/transmitter 140 is battery powered and can transmit at either of two RF carrier frequencies. Each transmitter 140 has a three position ON/OFF switch: OFF, ON 8 MHz, and ON 9 MHz. Two carrier frequencies are provided so that the user can select a different frequency if interference disrupts use of the training aid 100. The transmitted RF signal has a transmission range of about ten to fifteen feet-strong enough for reliable pickup by the training aid's controller 120, but weak enough not to require regulatory approval. To minimize power consumption, the transmitter 140 has a duty cycle of approximately 25%. The output of each sensor (left foot, right foot and grip) is distinctly encoded so that the information from two or more transmitters can be received and decoded simultaneously by the control unit 120.

In other embodiments, wireless transmissions of measurements signals from the sensors to the control unit may be accomplished using either electromagnetic frequencies outside the radio frequency band, such as the infrared frequencies used in many remote control devices, or by using ultrasonic transmissions.

The measurement signals transmitted by the encoder/transmitter 140 may be either analog or digital signals. In embodiments using digital signals, each packet of information transmitted by a sensor's encoder/transmitter includes an encoded identifier, which identifies the transmitter source, the encoded measurement information, and, optionally, an encoded address, which identifies the appropriate destination of the measurement information.

In alternate embodiments of the invention, the encoder/transmitter 140 may include a differentiating element that determines the rate of change of an impedance. Such an encoder/transmitter 140 would transmit a signal representing the rate at which the sensed parameter is changing. Alternately, the differentiating element may be located in the control unit 120. In the preferred embodiment, a microprocessor 160 in the control unit 120 can be programmed to compute the rate of change of a sensed parameter, thereby eliminating the need for such differentiating elements.

In an embodiment of the present invention which uses a foot sensor having multiple sensors located under different portions of the user's foot (e.g., the left foot), the sports training aid monitors for sequences of weight shifts between portions of the user's foot and generates feedback tones that indicate whether the user's weight shifts meet the specified criteria. Such weight shifts can be important in many sports motions.

In general, the present invention can use multiple sensors to monitor for prescribed motion sequences, where a proper motion is indicated by a sequence of sensor measurements that meet specified criteria.

The grip pressure sensor 112 is also a pressure sensitive sensor, but it is either secured on the handle of a golf club for sensing grip pressure or it can be embedded in or laminated onto a glove. In either case, the grip pressure sensor 112 is thin so as not to change the feel of the club, and is encased in a moisture resistant and non-slip cover (not shown). The transmitter/encoder 142 coupled to the grip pressure sensor 112 is similar to the transmitter/encoder coupled to the foot pressure sensors 110.

SPINE TILT AND SHOULDER ROTATION SENSORS

Figure 5:
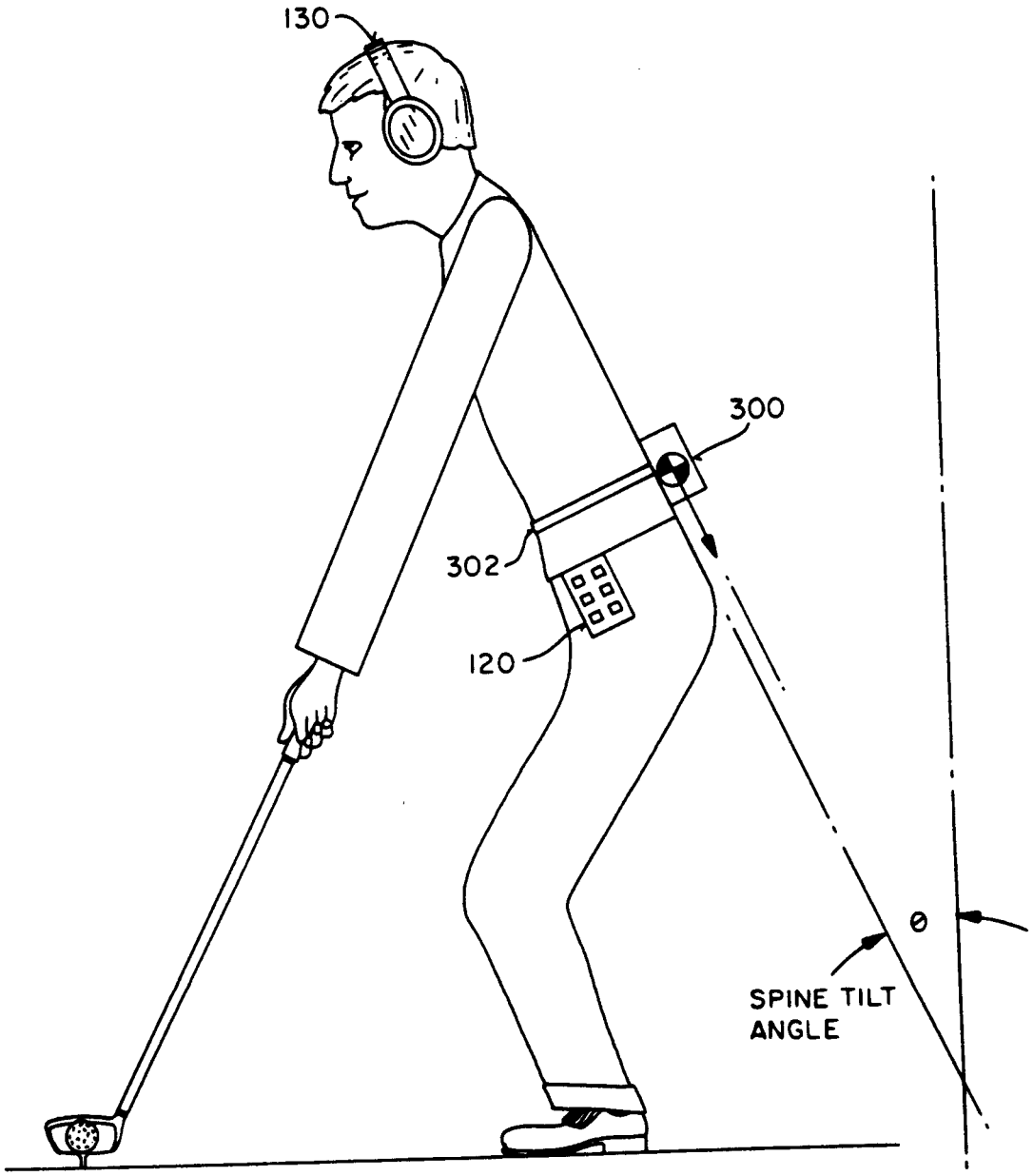
FIG. 5 depicts a person wearing a spin tilt sensor while preparing to swing a golf club.

Referring to FIG. 5, when the sports training aid is in spine tilt training mode, an inclinometer 300 is used to sense the inclination of the user's spine, and to generate a measurement signal indicative of the spine's angular inclination with respect to true vertical. Preferably, it is attached to the player's back, between the hips and the shoulder line, using an elastic band 302 encircling the player's torso. The inclinometer 300 is preferably an accelerometer set up to act as a variable impedance inclinometer, coupled to an encoder/transmitter 304 which reads the impedance of the inclinometer and transmits a corresponding signal to the control unit. Audible tones are generated by the sports training aid, indicative of the relationship between the measured value and a specified target value of spinal tilt, or a specified target range of spinal tilt values.

The tilt sensor employs either an inclinometer or a unidirectional accelerometer as an inclinometer, the accelerometer being mounted so that its sensitive axis is substantially parallel with the player's spine. The gravitational acceleration sensed by the accelerometer is expressed as $$\text{Acceleration} = g \cos\theta$$

where $\theta$ is the angle of spinal tilt and g is the vertical gravitation acceleration.

As with the foot and grip sensors, the encoder/transmitter 304 is battery powered and can transmit at either of two RF carrier frequencies. The transmitter has a duty cycle of approximately 25% in order to conserve battery power.

Figure 6:
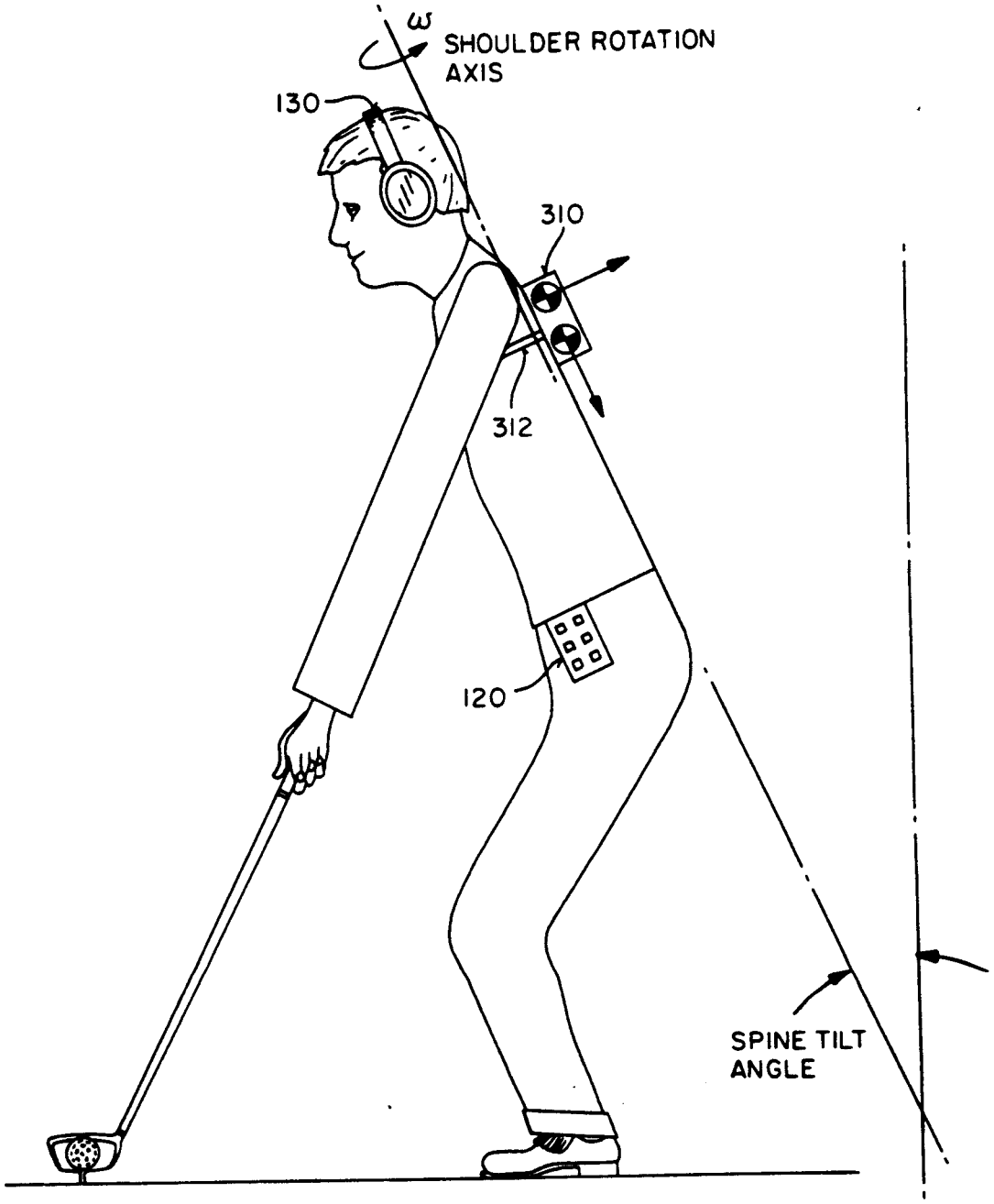
FIG. 6 depicts a person wearing a shoulder rotation sensor while preparing to swing a golf club.

Referring to FIG. 6, when the sports training aid in shoulder rotation training mode, the angle through which the shoulder line rotates about the spinal axis is sensed using an angular displacement sensor 310 attached to the user's body. Preferably, the angular displacement sensor is attached to the player's back, slightly below the shoulder line, using an elastic band encircling the player's torso or a simple harness 312 similar to that employed on backpacks. In the preferred embodiment the angular displacement sensor contains two accelerometers: one arranged to sense the normal component of rotation acceleration in a plane perpendicular to the player's spine and one used to measure any gravitational component of acceleration. The gravitional acceleration component is used to scale the normal component, and the resulting signal can then be double integrated with respect to time, providing a representation of the angular displacement of the player's shoulders.

CONTROL UNIT

The control unit 120, as shown in FIG. 2, is a small computer based controller which is used to calibrate the training aid, select its mode of operation, and to generate audio feedback signals that are heard by the user via a stereo headset 130. The control unit is contained in a small enclosure with a hinged clip for attaching it to the user's belt. The enclosure houses a pair of replaceable batteries along with all the circuitry shown in FIG. 2, excluding the sensors 110–112, encoders 140–142 and headset 130.

The control unit 120 has a microprocessor (CPU) 160, nonvolatile memory 162 such as ROM or EPROM which stores software, and volatile random access memory 164 for temporary storage of parameters, user selections, and so on. The CPU 160 is coupled to a user interface 170, located on the front face of the control unit 120 much like the user interface on a hand held radio.

USER INTERFACE.

The user interface 170 includes a liquid crystal display 172 for displaying various user prompts, values and the like while the system is in use. A Start/Stop key 174 activates and turns off the control unit. The control unit also automatically shuts off after a predefined period (e.g., ten minutes) of nonuse.

Whenever the Scan Key 176 is depressed, the control unit scans a narrow band of frequencies (e.g., 8 to 9 KHz) for signals being transmitted by sensor transmitters 140. A successful scan is signaled by sending one beep to the headset 130 if signals from one transmitter is received, or two beeps signals from two transmitters are received. An error message is displayed on LCD 172 if the scan is unsuccessful. An error message will also be displayed if the control unit 120 expects to receive signals from two transmitters (i.e., in weight shift mode) and only finds one.

Two sets of control keys 180 and 182 set threshold values. When the UP or DOWN portion of either key is depressed, the corresponding threshold value is displayed as it is incremented or decremented. In the preferred embodiment, the threshold values are displayed as a percentage value, between 0 and 100 percent. These threshold controls 180 and 182 control the operation of attenuators 184 and 186, respectively. The operation of these attenuators is discussed below. For the Weight Shift training program, the left threshold control 180 sets a threshold for weight on the left foot and the right threshold control 182 sets a threshold for weight on the right foot. More particularly, these controls set threshold values equal to percentages of the user's full weight. For example, the threshold controls 180 and 182 could be both set to a value of 75%, meaning that a tone will be generated by the training aid whenever the user puts more than 75% of his weight on either foot.

For the Grip Pressure training program, the left threshold control 180 sets the minimum acceptable grip pressure and the right threshold control 182 sets the maximum acceptable grip pressure. For instance, the threshold controls 180–182 can be set to 35% and 65%, meaning that a warning tone will be generated if the user's grip pressure falls below 35% or above 65% of the user's maximum grip pressure.

Volume control key 190 is used to control the audio volume of the left earphone in headset 130, and volume control key 194 is used to control the audio volume of the right earphone in the headset. The volume control keys also have secondary functions. These functions are accessed when the UP and DOWN portions of the left or right volume control key are simultaneously depressed and held for a period of time, such as one second. When this is done, the UP and DOWN portions of right channel key 194 are used to select between the programmable functions shown in Table 1, and the UP and DOWN portions of left channel key 190 are used to set the values of these functions. The selectable values can be scrolled up or down by holding the UP or DOWN portions of key 190 depressed. After five seconds of inactivity, the volume control keys 190–194 revert to their primary default functions. The programmed values are retained in memory 164 until reprogrammed or until the device's battery is disconnected.

The order of the functions, their default values and their selectable values are shown in Table 1.

TABLE 1

| FUNCTION | DEFAULT | SELECTABLE VALUES |
|---|---|---|
| MODE | Weight Shift | Grip, Weight Shift, Spine Tilt, Shoulder Rotation, Grip/W. Shift, Spine Tilt/W. Shift |
| ON DELAY | Zero | 0 to 99 seconds |
| ON TIME | Always On | 5 to 99 seconds & ON |
| LEFT TONE | 1.0 KHz | 0.3 to 2.0 KHz |
| RIGHT TONE | 1.5 KHz | 0.3 to 2.0 KHz |

Thus these control keys are used to determine whether the training aid is to run its Weight Shift training program or any of the other training programs. Additional application programs (called "modes" in Table 1) could be added for additional training modes, such as arm extension, wrist angle and position, and so on.

The ON DELAY is a time delay from the pressing of the START key to when the device begins to transmit tone modulated RF signals to the headset 130. The ON TIME is the time duration that the device will emit a tone modulated RF signal before turning off. LEFT TONE and RIGHT TONE are frequency values transmitted to the headset, and are programmable for user comfort.

If the ON DELAY has been programmed, then after the ON DELAY time the control unit begins outputting a "hum" tone to the headset when the preprogrammed thresholds have not been exceeded, and a distinct signal or tone when one of the thresholds has been exceeded. The delay prior to device activation encourages the golfer to establish a routine before executing his/her stroke and discourages rushing the stroke. It also avoids distractions caused by beeps while the player gets ready to make a stroke (e.g., while the player transfers weight between golf shoes prior to making a stroke). The ON DELAY applies only from depression of the START/-STOP key to activate the device.

Peak readings are not captured during the ON DELAY time, but ongoing sensor measurements are displayed on the LCD 172.

If an ON TIME has been programmed, the training aid remains activated only for the specified amount of time and then automatically turns off (i.e., it no longer generates background "hum" and warning tones). After automatic turn off the device is reactivated by again pressing the START/STOP switch. During the ON TIME, the control unit captures peak readings from the sensor/transmitters and displays them on the LCD 172 as a percentage of a 100% calibration value. The peak readings are displayed on the LCD 172 until they are reset by pressing the START/STOP switch to initiate another measurement cycle. After two minutes of no START/STOP activity, the LCD is turned off to conserve power. The LCD 172 and its values can be viewed again later by pressing one of the UP/DOWN volume control keys 190–196.

If a sensor's transmitter is not sensed after the START/STOP switch is pressed, then an error message is displayed on the LCD 172 and the generation of tones is inhibited. The user then must check that the sensor's transmitter 140 has been turned on, and that its battery is functional (each unit has a battery check LED that is lit so long as the battery is functional and the device is turned on).

The START/STOP key has a secondary function, calibration of signals from the sensor transmitters, discussed below in the section of this document entitled "OPERATION OF THE SPORTS TRAINING AID."

SIGNAL HANDLING CIRCUITRY.

The control unit has a radio frequency receiver/decoder 210 which receives and decodes RF signals transmitted by the transmitter/encoders 140. When the sensors are being calibrated, the received values are stored in memory registers 212 (MEM 1) and/or 214 (MEM 2). During normal operation, the received signal or signals are sent to a set of mode switches 220 which determine how those signals are to be used by two comparitors 222 and 224. The mode switches 220 determine which signals stored in MEM 1 and/or MEM 2 will be compared with signals received from the foot or grip sensors. The microprocessor 160 configures the mode switches 220 in accordance with the training or application program that has been selected by the user.

Attenuators 184 and 186 attenuate signals stored in MEM 1 and MEM 2 and send the resulting attenuated signals to the mode switches 220. The amount of attenuation is governed by the settings of the threshold controls 180 and 182. Then the comparitors 222 and 224 determine whether the user's movements are within or outside specified threshold values, which are determined by the memory registers 212–214 and the setting of the attenuators 184–186.

When a received signal is within the specified threshold(s), transmitter 250 sends a low "hum" to the headset which indicates that the training aid is working. When the received signal exceeds the specified threshold(s), transmitter 250 sends tone modulated RF signals to the headset 130. The particular tones sent to the headset depend on (1) whether a specified threshold is exceeded, and (2) the frequencies specified for the LEFT TONE and RIGHT TONE parameters, as discussed above.

As will be understood by those skilled in the art, the attenuators 184–186, memory registers 212–214, the mode switches 220, and comparitors 222–224 can be implemented in the CPU's software, stored in ROM 162, thereby reducing the number of individual components in the control unit 120. A number of commercially available microcontrollers contain built in analog-to-digital and/or digital-to-analog converters and could be used to implement the control unit 120 with very few peripheral components.

While FIG. 2 shows only one attenuator coupled to each memory register, and just two comparitors 222, 224, in a most preferred embodiment each of the two memory registers 212–214 is coupled to two corresponding attenuators, and the control unit has a total of four comparators which are coupled to selected ones of the attenuators by switch 220. This allows each incoming measurement signal to be separately compared to a corresponding, preselected range of values.

HEADSET

Headset 130 is stereo set of headphones 252 and 254 with a built-in receiver 256. The receiver 256 is housed in a small, light weight and waterproof container with battery access for easy battery replacement. There is a miniature jack on the receiver for connecting the headphones, and an ON/OFF switch (not shown).

OPERATION OF THE SPORTS TRAINING AID

Figure 3:
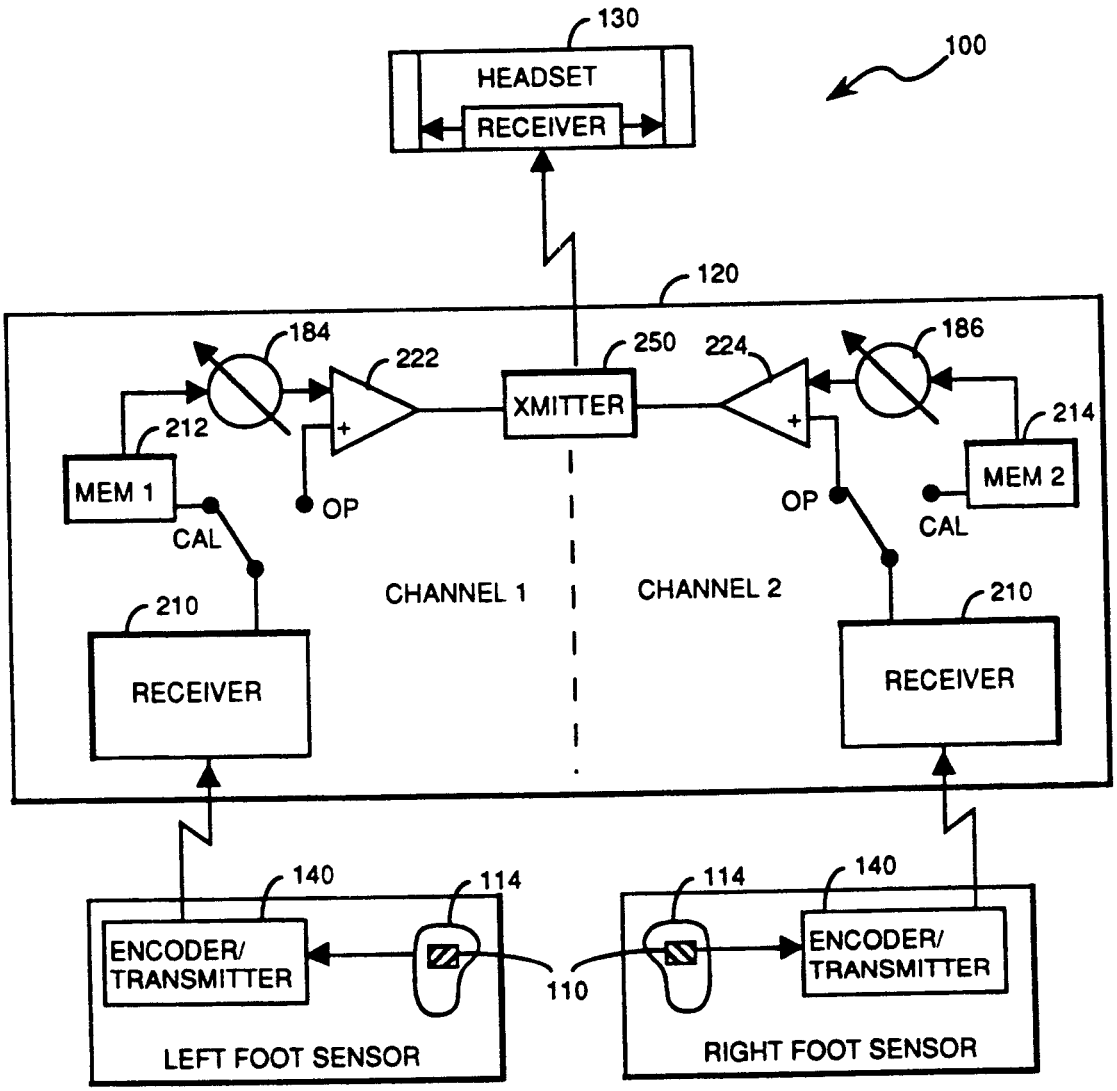
FIG. 3 is a functional block diagram of the present invention when used as a weight shift training aid.

FIG. 3 shows the configuration of the training aid when it is running the Weight Shift training program. In weight shift mode, the training aid must be calibrated to the user's weight before the weight shift training program can be used. To initiate calibration, the START/-STOP key 174 is held depressed for two seconds and then released. The user then stands on one foot. The peak response from the foot pad is detected by the control unit and stored in memory register 212. The control unit emits a short tone (i.e., sends a short tone to the headset) to signal completion of this calibration step. Then the user stands on his other foot and the control unit again obtains a peak reading, stores the value in memory register 214, and emits another short tone. Thus, both foot sensors are calibrated for 100% of the user's weight. During the calibration procedure, the LCD displays "CALIBRATE PADS". The peak signals for each foot sensor are stored in memory registers 212 and 214 and are compared with preset reference values in the training aid's software to make sure that the received values are "reasonable" (e.g., representative of a weight between 75 and 350 pounds).

The user sets the RIGHT threshold value by setting the RIGHT threshold control 180 for the percentage of his/her weight on the RIGHT foot sensor required to trigger a tone for the RIGHT audio channel of the headset. Similarly, the LEFT threshold control 182 is set to determine the LEFT threshold value. The CPU 160 then sets up attenuators 184–186 accordingly.

During normal use, when the START/STOP key is depressed, the weight or pressure signals from the RIGHT and LEFT foot sensors are continuously compared to the RIGHT and LEFT threshold settings after any programmed ON DELAY time. If the thresholds are exceeded, the control unit sends a RIGHT or LEFT channel tone modulated RF signal to the headset 130. The peak RIGHT and LEFT channel weight readings are held and displayed on the LCD 172. The training aid continues to operate in this manner until the ON TIME expires or the START/STOP key is depressed. Then the LCD 172 goes blank and the transmission of tones to the headset stops.

Figure 4:
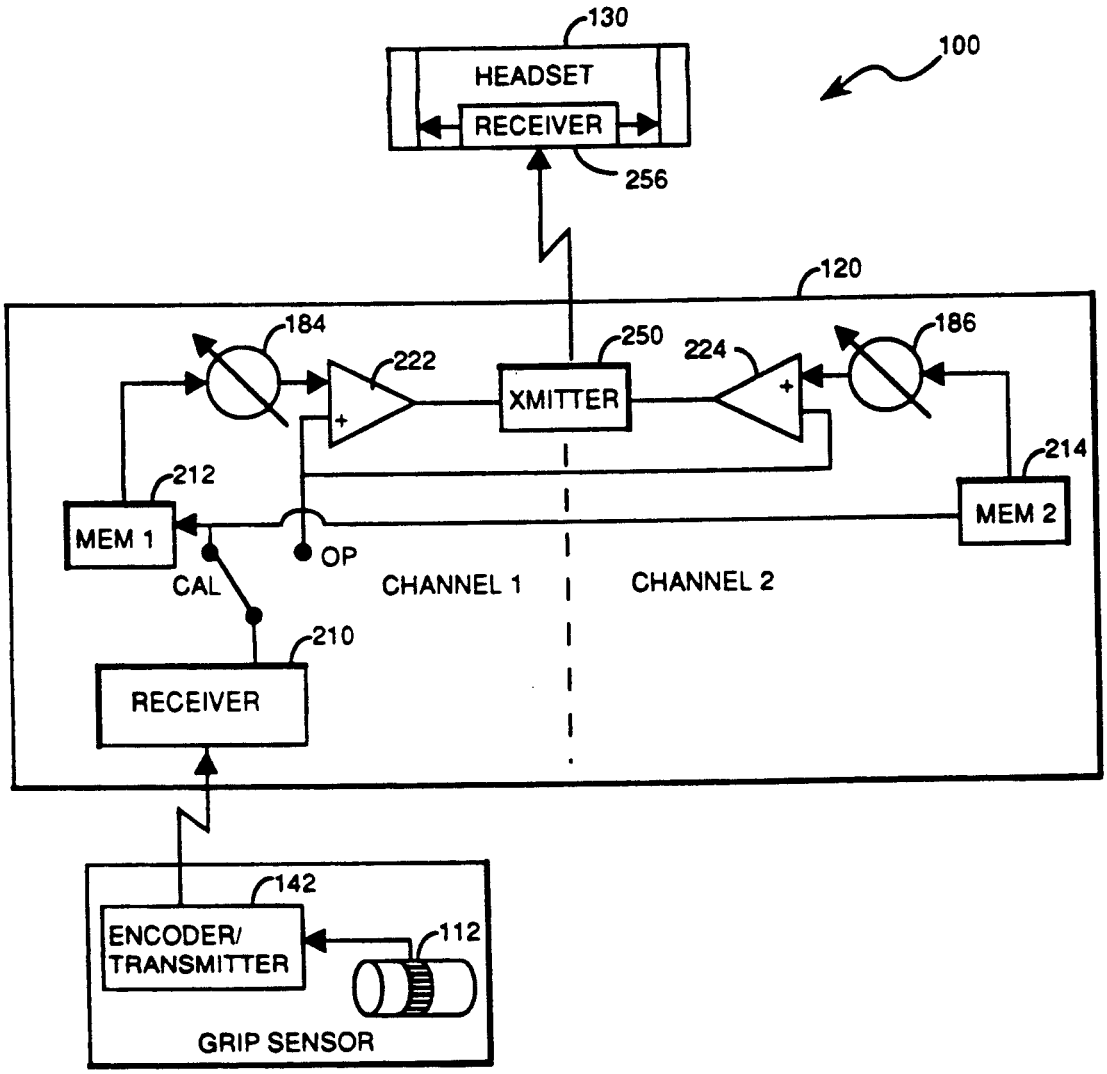
FIG. 4 is a functional block diagram of the present invention when used as a grip pressure training aid.

FIG. 4 shows the configuration of the training aid when it is running the Grip Pressure training program. In grip pressure mode, the training aid is calibrated to the user's grip pressure before the grip pressure training program is used. To initiate calibration, the START/-STOP key 174 is held depressed for two seconds and then released. The user then applies maximum grip pressure to the grip sensor attached to the golf club. The peak response from the grip sensor is detected by the control unit and stored in both memory registers 212 and 214. The control unit emits two short tones (i.e., sends a short tone to the headset) to signal completion of this calibration step.

The LEFT threshold control 180 sets the threshold for low grip pressure on the grip sensor (as a percentage of the user's maximum grip pressure) and the RIGHT threshold control 182 sets the threshold for high grip pressure. Whenever the user's grip pressure falls outside the low and high threshold limits, the control unit sends a modulated RF signal to the headset. The training aid continues to operate in this manner until the ON TIME expires or the START/STOP key is depressed. Then the LCD 172 goes blank and the transmission of tones to the headset stops.

Alternately, the sports training aid could be calibrated in grip pressure mode by having the control unit read the grip pressure sensors while the user applies the "correct" grip pressure, and then the RIGHT and LEFT threshold controls would be used to define a window of acceptable values above and below the calibrated grip pressure value.

Figure 7:
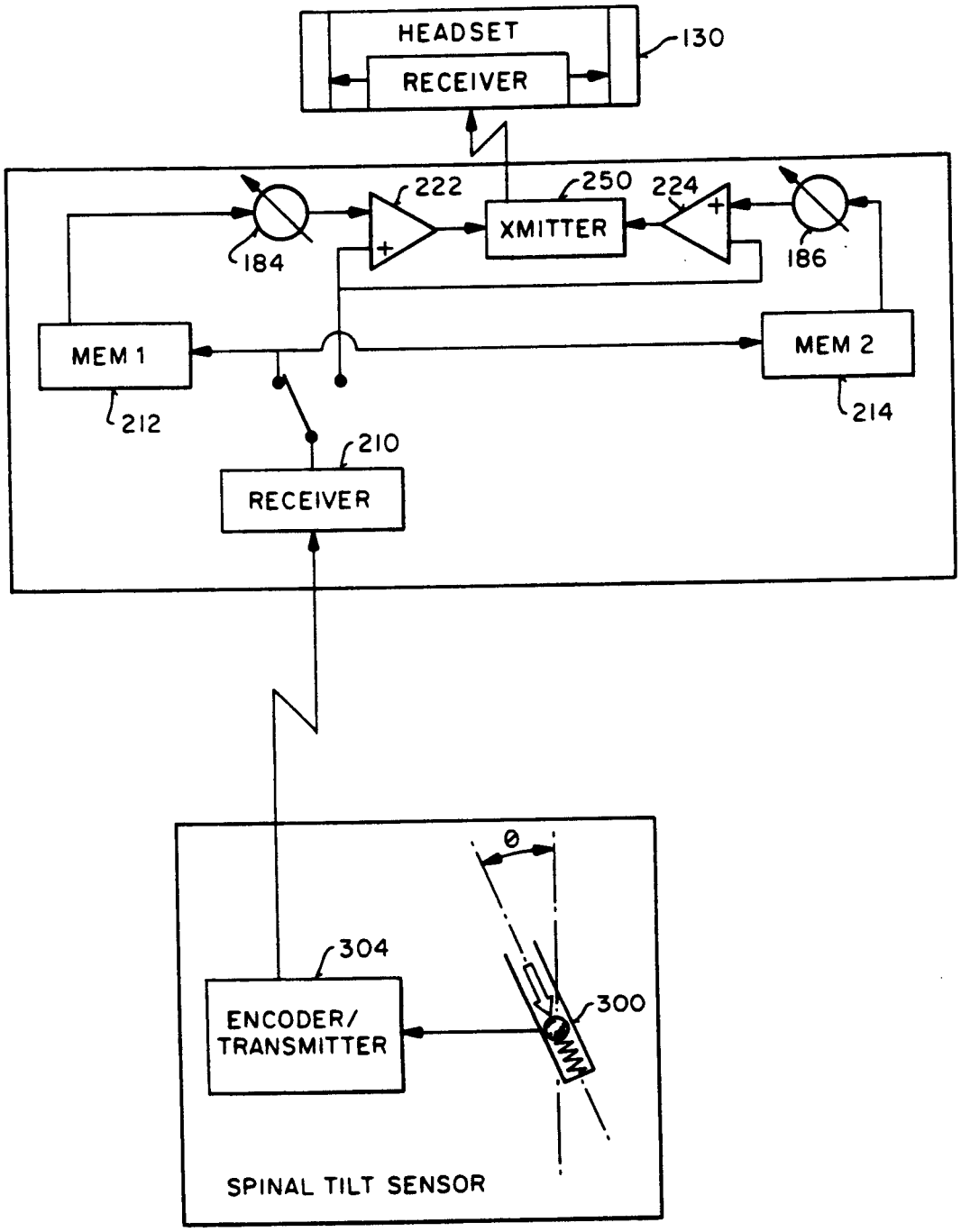
FIG. 7 is a functional block diagram of the present invention when used as a spine tilt training aid.

The spinal tilt sensor shown in FIG. 7 includes the accelerometer 300 and the encoder/transmitter 304. The accelerometer determines the angle of spinal tilt $\theta$, measured from vertical, and provides a corresponding input to the encoder/transmitter 304. The encoder/-transmitter 304 in turn transmits an appropriate signal to the receiver 210 located in the control unit. The control unit is shown here in the Calibration position, wherein the initial value of the player's spinal tilt is stored in memory registers 212–214. Attenuators 184 and 186 are then adjusted, using the LEFT and RIGHT threshold control keys 180 and 182, to provide the desired minimum and maximum tilt angles, thereby completing calibration.

During the player's swing, the sensor 300 will continuously sense the player's spinal tilt and send a corresponding signal to the control unit. The transmitted tilt value is compared by comparators 222 and 224 with the calibrated minimum and maximum tilt values, and the outputs from the comparators are fed to the transmitter 250 which sends signals to the headset 130. The headset's receiver generates tonal signals heard by the player. In the preferred embodiment, a tonal signal is sent to the player's left ear if the player's spinal tilt is less than the selected minimum and a tonal signal is sent to the player's right ear if his/her spinal tilt is more than the selected maximum.

Figure 8:
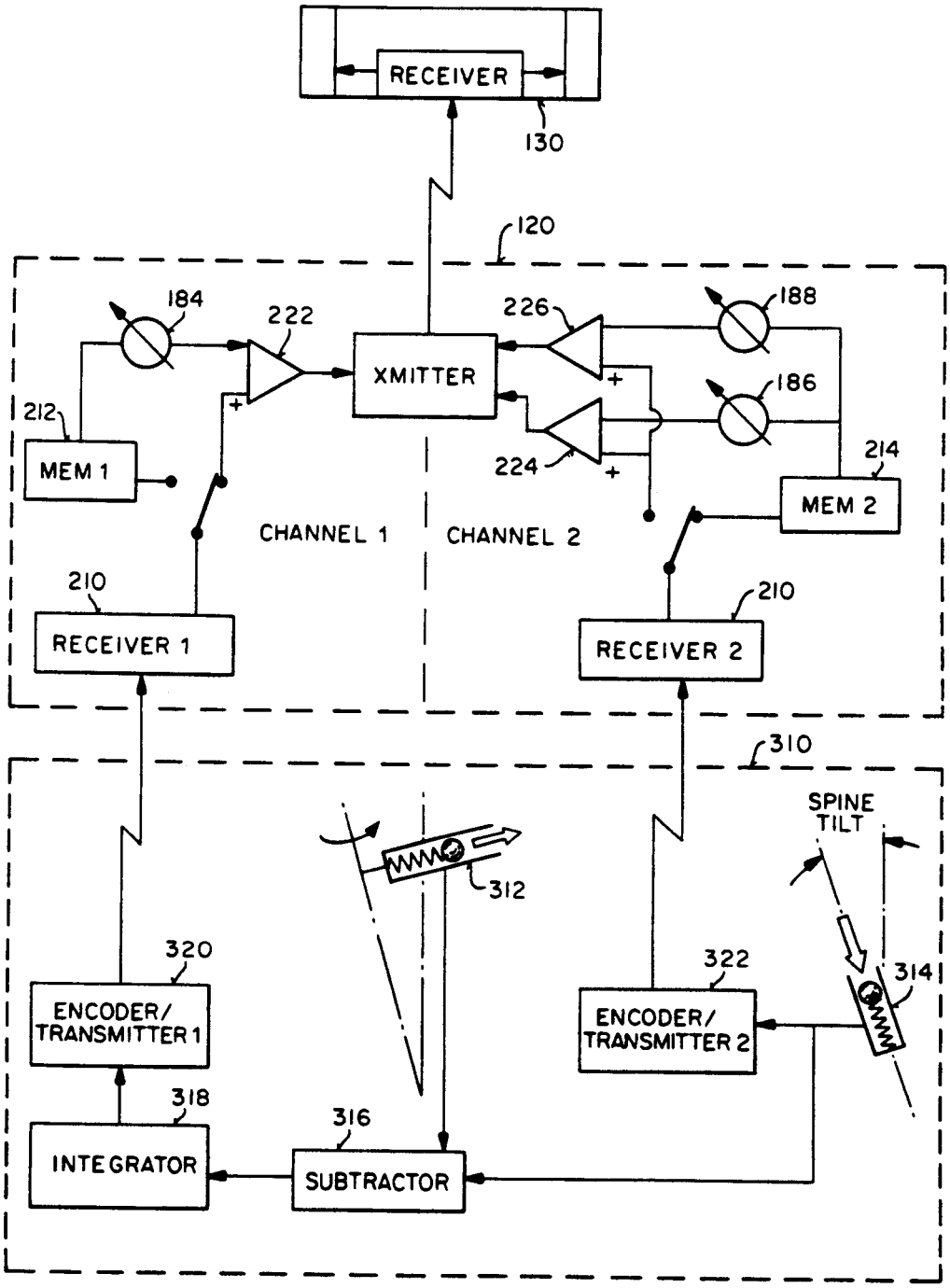
FIG. 8 is a functional block diagram of the present invention when used as a shoulder rotation training aid.

Referring to FIG. 8, the shoulder rotation sensor 310 contains two accelerometers 312 and 314: one arranged to sense the normal component of rotation acceleration in a plane perpendicular to the player's spine and one used to measure any gravitational component of acceleration. The gravitional acceleration component is used to scale the rotational signal with multiplier circuit 316, and the resulting signal can then be double integrated with respect to time by integrator 318, providing a representation of the angular displacement of the player's shoulders. Both the spinal tilt value and the integrated shoulder rotation value are transmitted by encoder/transmitters 320–322, which transmit corresponding signals to the receivers 210 located in the control unit.

The control unit is shown here in the Calibration position, wherein the initial value of the player's shoulder rotational position is stored in memory register 212 and the player's initial spinal tilt is stored in memory register 214. Attenuators 184, 186 and 188 are then adjusted, using the LEFT and RIGHT threshold control keys 180 and 182, to provide the desired minimum shoulder rotation value for a proper backswing, and an allowed spinal tilt angle deviation range, thereby completing calibration.

During the player's swing, the sensor 310 will continuously sense the player's shoulder rotation and spinal tilt and send corresponding signals to the control unit. The transmitted shoulder rotation value is compared by comparitor 222 with the calibrated minimum rotation value. During the backswing, prior to achieving the specified minimum rotational value a first tone is generated in the headset, and after that rotation value is achieved a second, different reinforcing tone is generated, letting the player know that he/she has achieved proper shoulder rotation. The transmitted spinal tilt is compared by comparitors 224 and 226 with the allowed range of spinal tilt values, and a buzzing sound is generated by the headset if the player sways outside this range during the backswing.

In another embodiment, the two accelerometer measurements are sent without further processing to the control unit, and integrator 318 is replaced with a software integration routine. This has the advantage of using less hardware, and also making it easy to reset the computed shoulder rotation angle to zero at the beginning of each golf swing.

In the preferred embodiment it is possible to operate the training aid in a number of "combined" modes of operation. For example, referring to FIG. 3, when the training aid is operated in GRIP/W.SHIFT mode, the right foot sensor 114 and encoder/transmitter 140 depicted therein is replaced with the grip sensor 112 and encoder/transmitter 142 of FIG. 4. By making such a substitution, channel 1 of the control unit 120 will monitor the weight applied to the left foot and, simultaneously, channel 2 will monitor grip pressure. Each sensor is calibrated separately using the calibration methodology described above. In this combined mode, the training aid helps the player learn to maintain proper grip pressure during the downstroke.

Another example of a combined mode of operation is the SPINE TILE/W.SHIFT mode of operation, illustrated by replacing the right foot sensor in FIG. 3 with the spinal tilt sensor of FIG. 7. In this mode of operation the first sensor signals a response to force/pressure exerted by a portion of the user's body while the second sensor signals a response to the position of a portion of the user's body. In using the control unit 120 of FIG. 3 in the above described combined modes, each channel of the control unit can compare an incoming signal with a single preselected value since each channel has only one memory attenuator and comparitor. By expanding the control unit circuitry and/or software to include two memory attenuators and two comparators per channel, each channel can compare an incoming signal to a preselected range of values.

Still another combined mode of operation was described above with reference to FIG. 8, where two aspects of the player's body position (spinal tilt and shoulder rotation) are monitored simultaneously. A first sensor signal corresponding to the player's spinal tilt is compared by comparators 224 and 226 with a preselected range of values as determined by memory register 214 and attenuators 186 and 188 while the other channel of the control unit compares a shoulder rotation signal with a single preselected value stored in memory register 212, as adjusted by attenuator 184.

PROGRAMMING FOR SKILL LEVEL, PREFERENCES IN STYLE, AND USER'S PHYSICAL TRAITS

It should be noted that an important aspect of the present invention is the degree of flexibility afforded the user in programming an individual training aid to suit his/her particular skill level. The beginning user may program his training aid initially to allow considerable latitude in executing a particular movement. As the user's skill improves, he/she may re-program the training aid to a higher or more demanding level, against which his/her performance will be compared. For example, while using the sports training aid in the weight shift mode, the beginning user may program both the left and right foot threshold values to provide audible feedback at 70 percent of his total weight. These settings are suitable to train the beginner in the fundamentals of weight shift. As his/her weight shift skill improves, the user may re-program the right foot threshold to 80 percent and the left foot at 100 percent of his/her total weight. These settings represent a more ideal weight shift pattern, but which is more difficult for the user to achieve.

Another important aspect of the present invention is the degree of flexibility afforded in programming the training aid to mimic the specific movement or style of a particular instructor or expert player. For example, it has been observed that one noted expert golf player maintains a spinal tilt of approximately 20 degrees throughout his backswing and downswing. Another noted expert player has a different style, wherein his spine tilt is observed to be approximately 40 degrees throughout his backswing and downswing. The user of the sports training aid in the spine tilt training mode can program the training aid to provide audible feedback at any specified nominal spine tilt, thereby enabling the user to mimic either of the two expert players.

Still another important aspect of the present invention is the degree of flexibility afforded the user in programming the training aid to suit his individual physique. For example, as already mentioned, the weight shift training aid is calibrated to the individual user's total weight. In the case of the spine tilt training mode, calibration is made while the sensor is being worn by the user, thereby taking into account the exact sensor location chosen by the user, together with the posture and spinal curvature peculiar to that individual user.

ALTERNATE EMBODIMENTS

While the preferred embodiment, in weight shift training mode, generates a tone if the user's weight applied to a sensor exceeds a specified threshold, in other embodiments a tone could be generated when less than a specified amount of weight is applied to a sensor. Alternately, different tones could be generated when the weight applied is less than or greater than a specified range of weight values. Yet another variation that could be easily implemented would be to vary the tonal frequency of the audio feedback signal so that the tonal frequency is related to the amount by which the user's weight borne on a particular foot differs from a preselected value (e.g., the frequency would increase as more weight is borne by that foot).

In another embodiment of the invention, the sensory feedback signals could be visual signals, such as those generated by a set of illuminating elements. The number of elements illuminated, or the amount of light generated could be made proportional to the amount by which the user's weight applied to a foot sensor exceeds a preselected value. Alternately, the illuminating elements could be made to flash when predetermined criteria are violated, or they could be made to flash at a frequency corresponding to the amount by which the weight borne by a foot exceeds or falls below a preselected value.

In yet another embodiment of the invention, the sensory feedback signals could be tactile signals, such as a vibratory signal generated by a vibrating element attached to the user's body. Vibrations would be generated only when predetermined criteria for weight distribution or grip pressure are violated. The frequency of vibration could also be modulated to correspond to the amount by which weight borne or grip pressure applied exceeds or falls below a preselected value.

Another variation on the preferred embodiments is that the sensors and/or headphones could be directly connected to the control unit by wires, rather than by wireless (e.g., radio) transmissions. While having such wires may be somewhat inconvenient to the user, the advantages of such an embodiment include not only reduced cost due to the elimination of transmitters and receivers, but also the ability to have all the batteries for the sports training system in the control unit (i.e., eliminating the need for separate batteries for each sensor, the control unit and headphones).

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A sports training apparatus, comprising:

sensing means, to which at least a portion of a user's weight is applied, for immediately generating measurement signals indicative of the amount of the user's weight applied to the sensing means; and signaling means for immediately receiving the measurement signals, for immediately comparing the measurement signals with a preselected and adjustable range of criteria, said range of criteria being set to selected percentages of a fixed quantity, said fixed quantity being determined solely by the user's total weight, and for immediately providing to the user sensory signals which undergo a distinct change when the measurement signal crosses a limit of the range and which thus immediately inform the user whether the amount of the user's weight applied to the sensing means is within a preselected range.

2. The sports training apparatus of claim 1, further including calibration means for registering a signal corresponding to the user's total weight, and for setting said preselected and adjustable range to selected percentages of the user's total weight.

3. The sports training apparatus of claim 1, wherein said sensory signals are audio signals audible by the user.

4. The sports training apparatus of claim 1 wherein the sensing means forms part of a shoe insert shaped for insertion into a user's shoe.

5. The sports training apparatus of claim 4 wherein the sensing means is located so that it senses the weight borne by at least a portion of the ball of the user's foot.

6. The sports training apparatus of claim 4 wherein the sensing means is located so that it senses the weight borne by the heel of the user's foot.

7. The sports training apparatus of claim 4 wherein there are two sensing means which form part of a single shoe insert shaped for insertion into a user's shoe, said two sensing means being positioned beneath different zones of the user's foot.

8. The sports training apparatus of claim 7 wherein one of the sensing means senses the weight borne by at least a portion of the ball of the user's foot and the other sensing means senses the weight borne by at least a portion of the heel of the user's foot.

9. The sports training apparatus of claim 1 wherein the preselected range can be adjusted so that it has a lower limit but no upper limit.

10. The sports training apparatus of claim 1 wherein the preselected range can be adjusted so that it has an upper limit but no lower limit.

11. The sports training apparatus of claim 1 wherein the preselected range can be adjusted so that it has a lower limit and an upper limit, and wherein the sensory signal is an audible signal which has a first tone when the weight applied to the sensing means results in a measurement signal which is less than the preselected range, and which has a second tone when the weight applied to the sensing means results in a measurement signal which is greater than the preselected range.

12. The sports training apparatus of claim 1 which further comprises a wireless transmitter adjacent to the sensing means for sending the measurement signals to the signaling means, and a receiver adjacent to the signaling means for receiving the measurement signals.

13. The sports training apparatus of claim 1, the signaling means simultaneously providing said sensory signals to the user and to a second person.

14. The sports training apparatus of claim 1 which further comprises a start means which activates the apparatus, and a delay means which delays the provision of said sensory signals to the user for a predetermined delay period after the apparatus has been activated by the start means.

15. A sports training apparatus comprising:

sensing means comprising first and second weight sensors to which at least a portion of a user's weight is applied, for immediately generating distinct measurement signals indicative of the amount of the user's weight applied to each of said weight sensors; and signaling means for immediately receiving said distinct measurement signals, for immediately comparing the amount of the user's weight applied to each of said first and second weight sensors with first and second predetermined criteria, and for immediately providing to the user distinct first and second sensory signals corresponding to said first and second weight sensors respectively; said sensor signals changing as the amount of the user's weight applied to each of said first and second weight sensors changes;

said first sensor signal including an audio signal of a first tonal frequency which denotes a predefined relationship between weight applied to the first weight sensor and said first predetermined criteria, and said second sensor signal including a second tonal frequency which denotes a second predefined relationship between weight applied to the second weight sensor and said second predetermined criteria;

whereby the user receives immediate sensory feedback regarding placement of the user's weight.

16. The sports training apparatus of claim 15, said first and second weight sensors forming part of two shoe inserts shaped for insertion into a user's left and right shoes, each insert including a weight sensor.

17. The sports training apparatus of claim 15, said signaling means simultaneously providing said sensory signals to the user and to a second person.

18. The sports training apparatus of claim 15 each of said first and second sensory signals being an audio signal having a tonal frequency which is related to the amount by which the user's weight applied to the respective weight sensor differs from a preselected value.

19. The sports training apparatus of claim 15 wherein the signaling means compares each of the distinct measurement signals with a respective preselected and adjustable range of criteria, and provides to the user distinct audio signals which undergo a distinct change when the measurement signal crosses a limit of the respective range, and which thus immediately inform the user whether the amount of the user's weight applied to the respective sensing means is within a preselected range.

20. The sports training apparatus of claim 19 wherein the first sensory signal is an audio signal directed to one of the user's ears and the second sensory signal is an audio signal directed to the other one of the user's ears.

21. The sports training apparatus of claim 15 which further comprises a start means which activates the apparatus, and a delay means which delays the provision of said sensory signals to the user for a predetermined delay period after the apparatus has been activated by the start means.

22. A sports training apparatus, comprising:

a pair of weight sensors, insertable in a pair of shoes, which immediately generate measurement signals indicative of weight applied to each of said weight sensors;

a calibration means for denoting a range of weight values;

a speaker for generating audible sounds; and comparator means coupled to said pair of weight sensors, said calibration means and said speaker, for immediately comparing said measurement signals with said range of weight values and for immediately sending audio control signals to said speaker so as to immediately produce audible sounds indicative of the relationship between said measurement signals and said range of weight values;

said comparator means sending audio control signals so as to produce distinct audible sounds for each said weight sensor indicative of whether weight applied to each weight sensor is within said range of weight values;

whereby a user of said sports training apparatus receives immediate audible feedback regarding the user's weight distribution.

23. The sports training apparatus of claim 22, wherein said speaker comprises a pair of headphones; and said comparator sends audio control signals to each one of said pair of headphones indicative of whether weight applied to a corresponding one of said weight sensors is within said range of weight values.

24. The sports training apparatus of claim 22, said sports training apparatus including wireless transmitters and a receiver for sending measurement signals from said weight sensors to said comparator means;

whereby said weight sensors and comparator means need not be physically connected.

25. A sports training apparatus, comprising:

a grip pressure sensor which immediately generates measurement signals indicative of grip pressure applied to the handle of a swingable object;

signaling means for immediately receiving said measurement signals generated by said grip pressure sensor, for immediately comparing the user's grip pressure with predetermined criteria comprising a preselected value, and for immediately providing corresponding sensory signals to the user; said sensory signals changing as the user's grip pressure changes; and calibrations means for recording a signal indicative of the user's maximum grip pressure, for selecting a percentage value thereof, and for setting said preselected value to said selected percentage of the user's maximum grip pressure;

whereby the user receives immediate sensory feedback regarding the user's grip pressure.

26. The sports training apparatus of claim 25, wherein said predetermined criteria comprises a range of values surrounding a specified value.

27. The sports training apparatus of claim 25, wherein said predetermined criteria are adjustable to match said user's skill.

28. The sports training apparatus of claim 25, wherein said sensory signal is an audio signal audible by the user.

29. The sports training apparatus of claim 25 wherein the comparator compares the user's grip pressure with a preselected and adjustable range of criteria and provides to the user sensory signals which undergo a distinct change when the user's grip pressure crosses a limit of the preselected range.

30. The sports training apparatus of claim 25 which further comprises a start means which activates the apparatus, and a delay means which delays the provision of said sensory signals to the user for a predetermined delay period after the apparatus has been activated by the start means.

31. The sports training apparatus of claim 25, said signaling means simultaneously providing said sensory signals to the user and to a second person.

32. A sports training apparatus, comprising:

a grip pressure sensor which immediately generates a measurement signal indicative of grip pressure applied to the handle of a swingable object;

calibration means for denoting a range of pressure values;

a speaker for generating audible sounds; and comparator means coupled to said pressure sensor, said calibration means and said speaker, for immediately comparing said measurement signal with said range of pressure values and for immediately sending audio control signals to said speaker so as to immediately produce audible sounds indicative of the relationship between said measurement signal and said range of pressure values;

whereby a person using said sports training apparatus receives immediate audible feedback regarding maintenance of grip pressure within said range of pressure values.

33. The sports training apparatus of claim 32, wherein said speaker comprises at least one headphone.

34. The sports training apparatus of claim 32, said sports training apparatus including wireless transmitters and a receiver for sending measurement signals from said grip pressure sensor to said comparator;

whereby said grip pressure sensor and comparator need not be physically connected.

35. A sports training apparatus, comprising:

a plurality of sensing means, said plurality of sensing means including first and second weight sensors and a grip pressure sensor;

mode selection means for selecting one of a plurality of predefined training modes, each training mode using specified ones of said plurality of sensing means; and signaling means, coupled to said mode selection means, for immediately receiving said signals generated by said ones of said sensing means corresponding to said selected training mode, for immediately comparing the received signals with predetermined criteria, and for immediately providing corresponding sensory signals to the user;

when a first one of said training modes is selected, said signaling means comparing the amount of the user's weight applied to each of said first and second sensors with said predetermined criteria, and providing distinct first and second corresponding sensory signals to the user; and when a second one of said training modes is selected, said signaling means comparing the user's grip pressure with predetermined criteria, and providing corresponding sensory signals to the user;

whereby the user receives immediate sensory feedback from the specified ones of said plurality of sensing means.

36. The sports training apparatus of claim 35, wherein said predetermined criteria in at least one of said training modes comprises a range of values surrounding a specified value.

37. The sports training apparatus of claim 35, wherein said predetermined criteria in at least one of said training modes comprises a preselected value;

said apparatus further including calibration means for recording a signal indicative of the user's total weight, for selecting a percentage value, and for setting said preselected value to said selected percentage of the user's total weight.

38. The sports training apparatus of claim 35, wherein said predetermined criteria are adjustable to match said user's skill.

39. The sports training apparatus of claim 35, wherein said sensory signal is an audio signal audible by the user.

40. The sports training apparatus of claim 35 which further comprises a start means which activates the apparatus, and a delay means which delays the provision of said sensory signals to the user for a predetermined delay period after the apparatus has been activated by the start means.

41. The sports training apparatus of claim 35, said signaling means simultaneously providing said sensory signals to the user and to a second person.

42. A method of training a person to distribute and shift the person's weight in accordance with a prescribed weight distribution pattern, the steps of the method comprising:

placing independent weight sensing means beneath each of the person's two feet;

sensing the weight borne by each of said independent sensing means;

comparing the weight borne on a first one of said independent sensing means with a first prescribed value, and providing a first corresponding sensory feedback signal to the person; and comparing the weight borne on the other one of said independent sensing means with a second prescribed value, and providing a second corresponding sensory feedback signal to the person;

said first and second sensory signals including an audio signal of a first tonal frequency which denotes a predefined relationship between weight borne by the person's first foot and said first prescribed value, and an audio signal of a second tonal frequency which denotes a predefined relationship between weight borne by the person's other foot and said second prescribed value.

43. The training method of claim 42, wherein said first sensory signal is an audio signal directed to one of the user's ears and said second sensory signal is an audio signal directed to the other one of the user's ears.

44. The training method of claim 42, further including:

simultaneously providing said sensory signals to the person whose weight is being sensed and to a second person.

45. The training method of claim 42, including providing audio signals each having a tonal frequency which is related to the amount by which the person's weight borne by a corresponding foot differs from a preselected value.

46. A method of training a person to maintain proper grip pressure on a swingable object, the steps of the method comprising:

positioning a grip pressure sensor between at least one of the person's hands and a swingable object;

calibrating a prescribed value by registering a signal indicative of the person's maximum grip pressure;

selecting a percentage value of the person's maximum grip pressure;

sensing the person's grip pressure on the swingable object;

comparing said grip pressure with the selected percentage value of the person's maximum grip pressure; and providing a corresponding sensory feedback signal to the person.

47. A method of training a golfer to distribute the golfer's weight in accordance with a prescribed weight distribution pattern, the steps of the method comprising:

placing weight sensing means beneath one of the golfer's feet;

sensing the weight borne by said one of the golfer's feet;

comparing the weight borne by said one of the golfer's feet with a preselected and adjustable range of criteria, said range of criteria being set to selected percentages of a fixed quantity, said fixed quantity being determined solely by the user's total weight; and immediately providing to the golfer sensory signals which undergo a distinct change when the weight borne by said one of the golfer's feet crosses a limit of said preselected range.

48. The method of claim 47 wherein there is a single weight sensing means which is placed under one of the golfer's feet.

49. The method of claim 48 wherein the single weight sensing means is placed under the golfer's left foot.

50. The method of claim 48 wherein the single weight sensing means is placed under the golfer's right foot.

51. The method of claim 47 wherein there are two weight sensing means, one of which is placed under the ball of one of the golfer's feet and the other of which is placed under the heel of said one of the golfer's feet.

52. The method of claim 51 wherein the two weight sensing means are placed under the golfer's left foot.

53. A method of training a person to maintain proper grip pressure on a swingable object, the steps of the method comprising:

positioning a grip pressure sensor between at least one of the person's hands and the swingable object;

continuously generating measurement signals indicative of the person's grip pressure on the swingable object;

continuously and immediately comparing the person's grip pressure with a preselected and adjustable range of criteria; and providing to the person sensor signal which undergo an immediate and distinct change when the person's grip pressure crosses a limit of said preselected range.

54. A method according to claim 53 wherein a golfer is trained to maintain proper grip pressure on a golf club.

55. A sports training apparatus comprising:

sensing means comprising first and second weight sensors to which at least a portion of a user's weight is applied, for immediately generating distinct measurement signals indicative of the amount of the user's weight applied to each of said weight sensors; and signaling means for immediately receiving said distinct measurement signals, for immediately comparing the amount of the user's weight applied to each of said first and second weight sensors with first and second predetermined criteria, and for immediately providing to the user distinct first and second sensory signals corresponding to said first and second weight sensors respectively; said sensor signals changing as the amount of the user's weight applied to each of said first and second weight sensors changes;

said first sensory signal being an audio signal directed to one of the user's ears and said second sensory signal being an audio signal directed to the other one of the user's ears;

whereby the user receives immediate sensory feedback regarding placement of the user's weight.

* * * * *